United States Patent [19]

Beam

[11] 4,072,310

[45] Feb. 7, 1978

[54] CONTROL APPARATUS FOR A CARD GAME SIMULATOR

[76] Inventor: Dale R. Beam, 3243 Windmill Drive, Dayton, Ohio 45432

[21] Appl. No.: 649,504

[22] Filed: Jan. 15, 1976

[51] Int. Cl.[2] ..... A63B 9/00

[52] U.S. Cl. ..... 273/1 E; 273/148 R

[58] Field of Search ..... 35/8 A, 8 B, 9 C; 273/1 E, 134 A, 136 A, 138 A, 148 R, 149 P, 151; 235/92 GA; 340/324 A, 324 AD, 323 R

[56] References Cited

U.S. PATENT DOCUMENTS

| | | | |
|---|---|---|---|
| 2,023,210 | 12/1935 | Potter | 273/151 |
| 3,529,829 | 9/1970 | Seifert | 273/149 P |
| 3,579,856 | 5/1971 | Way | 273/136 A |
| 3,865,368 | 2/1975 | Grazebrook | 273/138 A |
| 3,876,208 | 4/1975 | Wachtler et al. | 273/138 A |
| 3,889,956 | 6/1975 | Castle | 273/1 E |
| 3,895,375 | 7/1975 | Williams | 340/324 AD |
| 3,962,800 | 6/1976 | Feldheim | 273/138 A |

*Primary Examiner*—Richard T. Stouffer
*Assistant Examiner*—Vance Y. Hum
*Attorney, Agent, or Firm*—Biebel, French & Nauman

[57] ABSTRACT

A card game simulator simulates a card game by means of a set of hand displays, which may be seen only by one player at a time, and a set of corresponding play displays, which may be seen by all players. Each hand display includes a set of light emitting diodes which are lit to indicate the cards held by the hand simulated by that display. Cards are played by placing a photosensing probe against an activated light emitting diode, which action causes the corresponding play display to indicate the playing of the card corresponding to the light emitting diode sensed by the photosensor. The light emitting diode in the hand display is then de-activated. The invention as disclosed is adapted for simulating a game of bridge, and the circuitry for the simulator includes a recirculating hand memory for cyclic sequential readout of fifty-two hand codes and a recirculating trick memory for cyclic sequential readout of fifty-two trick codes. The two memories recirculate in synchronism, and the output codes correspond respectively to hand assignments and trick assignments for the fifty-two cards in a standard bridge deck. Cards are indicated on the hand displays and play displays in accordance with the hand codes and trick codes read out from the hand memory and the trick memory. Hand codes may be loaded into the hand memory in a random sequence for simulating a standard game of bridge, or they may be loaded in a predetermined sequence from a programming unit for playing duplicate or team bridge.

18 Claims, 14 Drawing Figures

CONTROL APPARATUS FOR A CARD GAME SIMULATOR

CROSS REFERENCE TO RELATED APPLICATION

This application contains disclosure which is common with disclosure in Bradley Ser. No. 649,503 filed on even date herewith, now abandoned. The Bradley invention, which is generic in nature, was prior in time to the invention claimed herein.

BACKGROUND OF THE INVENTION

This invention relates to adult games and more particularly to apparatus for simulating a game of cards. Prior art card game devices are described in Gerfin U.S. Pat. No. 3,735,982, Fraley et al U.S. Pat. No. 3,796,433, Grazebrook U.S. Pat. No. 3,865,368, Wachtler et al U.S. Pat. No. 3,876,208, and Castle U.S. Pat. No. 3,889,956. These prior art devices are so designed as to enable a single player to play against the machine and therefore are suited for coin operation in gaming parlors and the like. None of these devices are configured to permit a plurality of players to play against one another.

The invention is particularly well suited for simulating a game of bridge, which is generally considered to be the most popular card game in the world. Bridge is played in a variety of settings from casual party play to keen international competition. In both casual and competitive environments people play bridge with the idea of improving their skills, and after most hands there is a certain amount of conversation concerning the cards held at the start of the game, the actual sequence of play, and the possible alternative plays.

For all but the best players the post game conversation is limited by the accuracy of the players' memories. This situation makes it fairly difficult for beginners and even more advanced players to see their errors and alternatives clearly. Heretofore it has been common for bridge players to review their play by using pencil and paper to record the deal and the sequence of play. Such a procedure is slow and cumbersome and detracts from the fun of the game.

SUMMARY OF THE INVENTION

This invention provides control apparatus for a card game simulator including novel relatively low cost circuit arrangements. In one aspect the invention includes hand displays which simulate playing cards by periodic illumination of card indicating lights. The frequency of illumination of the lights is sufficiently high for creation of a visual appearance of continuous illumination. Since the illumination is periodic, however, the time or phase of illumination of any light provides an identification of the card being simulated.

For playing of the cards there is a photodetecting device which can sense any card indicating light selected by any player. When a player causes sensing of a light indication in his hand display, the simulator recognizes the light being sensed and inhibits further illumination of that light. Thus the simulator is able to simulate the playing of any card without requiring a large number of card designating switches.

In another aspect the invention includes control apparatus having a sequentially accessed hand memory and a recirculating trick memory, which are loaded respectively with hand codes and trick codes to designate the hand to which each card is assigned and the trick during which each card is played. The two memories are accessed in synchronism with the generation of card designation signals by a card designating device, which device cooperates with the two memories to control the indication of cards in the hands being simulated. Thus there is eliminated any requirement for a large storage capacity and associated input and output buffers.

Further in accordance with this invention there are provided play displays as well as hand displays which indicate cards by periodic illumination of light emitting diodes. Diodes are selected for illumination by steering means responsive to a hand memory and a trick memory, and selection of any light is prevented after detection of that light by a hand held photodetecting probe. The invention also provides means for generating hand codes to be loaded into the hand memory for continuous recirculation, such hand code loading being performed at random times during recirculation of the hand memory or alternatively at predetermined times in response to signals from a programming unit.

It is therefore an object of this invention to provide card game simulating apparatus at a low, commercially acceptable cost.

It is another object of the invention to provide a card game simulator which can deal hands, indicate cards so dealt, and keep track of cards which have been played, all without need for a large memory capability.

Still another object of the invention is to simulate a game of bridge in an efficient, convenient, and cost effective manner.

Other and further objects of the invention will be apparent from the following description, the accompanying drawings and the appended claims.

DESCRIPTION OF THE PREFERRED EMBODIMENTS

Figure 1:
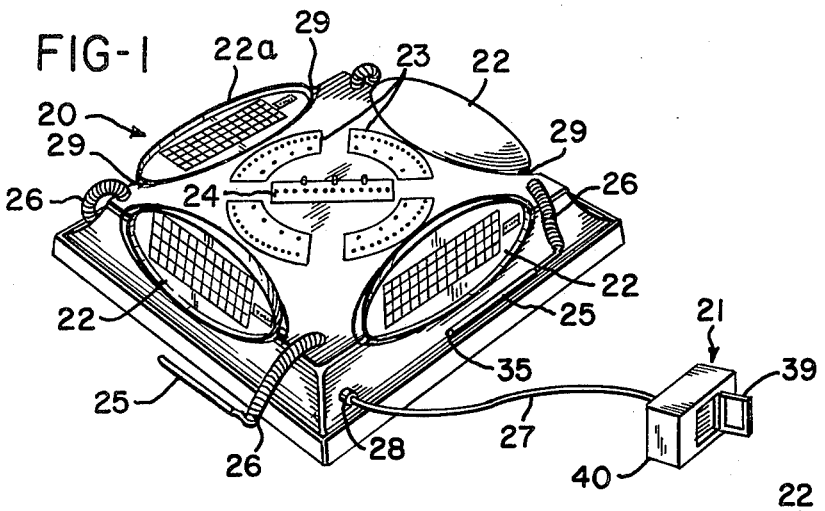
FIG. 1 is a perspective drawing of a card game simulator for simulating a game of bridge.

A card game simulator made in accordance with this invention may simulate a variety of card games, but as hereinafter described in detail the simulator simulates a game of bridge played by four players. Accordingly, as illustrated in FIG. 1, there may be provided a display unit 20 comprising four hand displays 22, three of which are positioned for viewing by only one player. All four hand displays 22 are pivoted as at 29 for rotation into position to be viewed from the other playing positions.

The hand display designated 22a is so rotated and serves as a dummy hand. Any of the four hand displays 22 may serve as the dummy hand.

Display unit 20 further comprises four play displays 23 and a trick display 24. Each of the displays is equipped with light emitting diodes, which are activated for simulating different aspects of the game. There are also four detection probes 25 equipped with photosensors 35 for detecting the above mentioned light emitting diodes. Each detecting probe 25 is attached to display unit 20 by means of a connecting wire 26.

Figure 2:
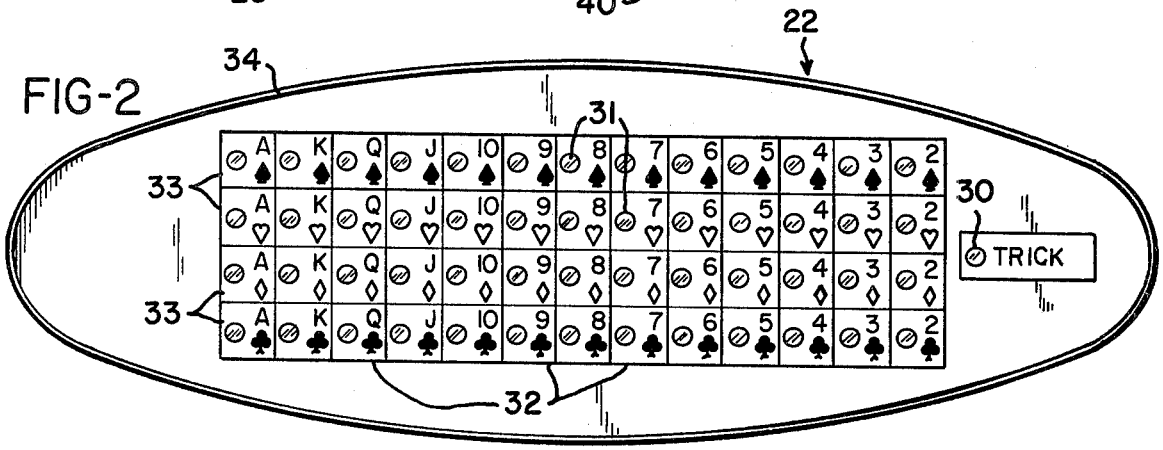
FIG. 2 is an illustration of the face of a hand display.
Figure 3:
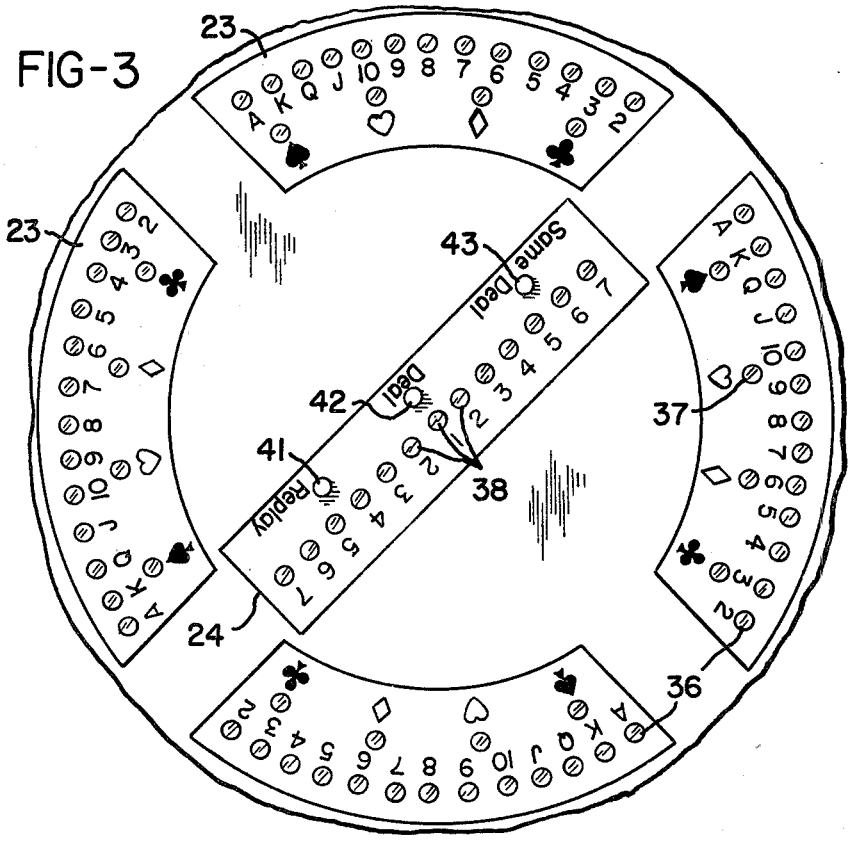
FIG. 3 is an illustration of the face of a play display.

Referring now to FIG. 2 it will be seen that a hand display 22 comprises a panel 34 and fifty-two light emitting diodes 31. Light emitting diodes 31 are arranged in thirteen columns 32 and four rows 33 to simulate any of the fifty-two cards in a standard bridge deck. At the beginning of any hand each hand display 22 will have thirteen light emitting diodes 31 illuminated for simulation of the cards dealt to the player at that playing position. Light emitting diodes 31 are not illuminated continuously but rather at a high frequency for creation of apparently continuous illumination. As discussed in detail hereinafter, means are provided for sequential generation of card designation signals designating each of the cards in the deck. The light emitting diodes 31 corresponding to the card designator signals are illuminated each time the system cycles through their designating signal, but the designated light emitting diode 31 is illuminated in only one of the four hand displays 22.

A card is played from a hand display 22 by placing the photosensor 35 of a detecting probe 25 against the corresponding light emitting diode 31. This causes cessation of the periodic illumination of the light emitting diode 31 and causes the card so played to be simulated on a corresponding play display 23.

Play displays 23 each comprise thirteen value indicating light emitting diodes 36 and four suit indicating light emitting diodes 37. Thus when a card is played from a hand display 22 one light emitting diode 36 and one light emitting diode 37 is illuminated on the corresponding play display 23 to indicate the card being played. Again, illumination of light emitting diodes on play displays 23 is carried out on an intermediate basis but at a high enough frequency to produce a visual appearance of continuous illumination.

After simulated cards have been played from all four play displays 22, then one of the two trick-winning partners places the end of his probe 25 against a light emitting diode 30 on his hand display 22. This extinguishes the illuminated light emitting diodes on play displays 23 and increments a trick counter for the partnership. There are two such trick counters as hereinafter described, and the output from these trick counters operate light emitting diodes 38 on the trick displays 24. One light emitting diode 38 is illuminated for each side, and the light emitting diodes so illuminated progress from the two ends toward the middle.

The numbers appearing on trick display 24 indicate the number of tricks made on a contract. Thus if, for instance, one side has won eight tricks toward a contract, the light emitting diode above the number "2", as viewed from one side, will be illuminated. The next trick indication for that side will extinguish the light emitting diode 38 positioned above the number "2" and activate the light emitting diode above the number "3". Meanwhile a light emitting diode 38 will be illuminated to indicate the count for the other side, but for the defending side the number adjacent the trick counting LED 38 is meaningless.

For normal operation a game is started by depressing the "deal" button 42, which causes a random time-out unit to deal or assign cards on a random basis to the four hand displays 22. However, a previously dealt hand may be replayed by depressing the "same deal" button 43 on trick display 24. This prevents the above mentioned random time-out unit from reloading a hand memory as hereinafter described. There is also a "replay" button 41 on trick display 24, which may be depressed to replay an entire hand. When this button is depressed, the play displays 23 indicate the cards played during the first trick of the preceding hand, and the hand displays 22 indicate the cards remaining in the four hands after playing of the first trick. Thereafter the end of a detecting probe 25 may be placed against any of light emitting diodes 30 to recreate the status of the play displays and hand displays after the second trick. The process is continued to replay the entire hand.

As illustrated in FIG. 1 there is also a programming unit 21 provided with a connecting wire 27 and a plug 28 for attachment to display unit 20. Programming unit 21 comprises a main frame 40 and a door 39. A programming card 44 (FIG. 11) may be placed in programming unit 21, after which door 39 may be closed and latched in place. When programming unit 21 is connected to display unit 20, the display unit does not assign cards to the hand displays 22 on a random basis but rather on a predetermined basis in accordance with a punched code on the card 44. Thus the simulator is adapted for use in playing duplicate bridge.

Figure 4:
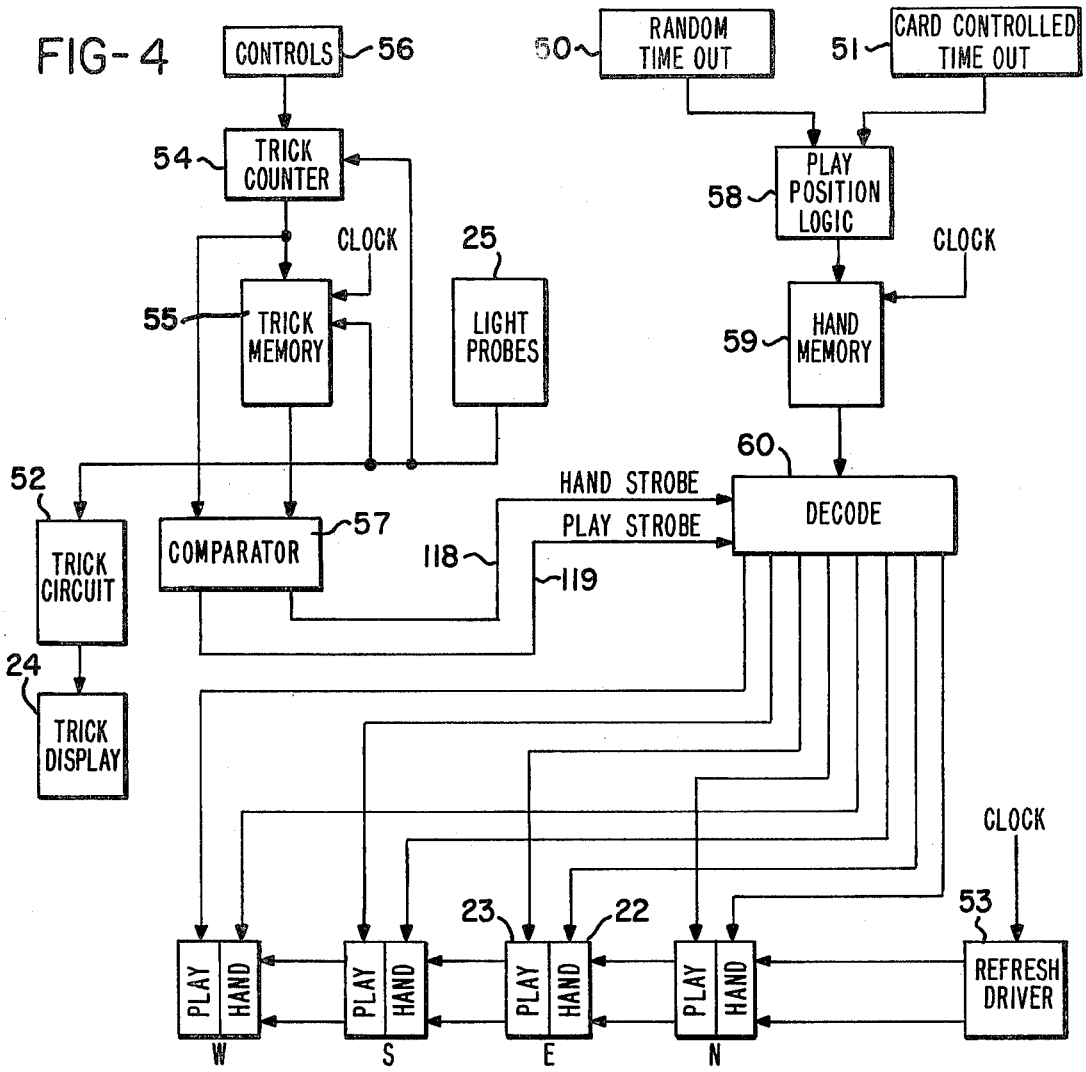
FIG. 4 is a schematic block diagram illustrating the functional relationship of major electronic components of the simulator of FIG. 1.

Referring now to FIG. 4 it will be seen that the simulator comprises a trick memory 55 and a hand memory 59. Trick memory 55 and hand memory 59 are recirculating shift registers, which operate in synchronism and are adapted respectively for loading of 52 trick codes and 52 hand codes. The sequential position of any such codes in its memory corresponds to a card to which that code is assigned. Initially hand memory 59 is loaded with 52 four-bit codes indicating the four hands to which the 52 cards are assigned. A play position counter 58 generates each of the four hand codes, and these codes are loaded into hand memory 59 in sequential positions as determined by random time-out unit 50 or card control time-out unit 51.

A refresh driver 53 continuously generates card designation signals in synchronism with the operation of memory 55 and 59, and transmits the signals to all of play displays 22 and hand displays 23. The card designation signals are steered to the correct play display or hand display by decoding unit 60.

Decoding unit 60 operates under the control of hand codes read out from hand memory 59 and from hand strobes and play strobes received respectively on lines 118 and 119 from an arithmetic logic unit 57. Arithmetic logic unit 57 has an input from trick memory 55 and from trick counter 54. When the trick code read out from trick memory 55 is the same as trick code received from trick counter 54, it means that the card corresponding to the trick code read out at that instant from trick memory 55 has been played during the current trick. Under these conditions arithmetic logic unit 57 generates a play strobe on line 119, while at the same time hand memory 59 is generating a hand code indicating the hand to which the card then being simulated has been assigned. Accordingly decoding unit 60 activates or enables the play display 23 at the correct playing position, so that the card then being designated by refresh driver 53 may be simulated in the correct display.

As also shown in FIG. 4, trick counter 54 is under the general control of a control unit 56 and counts tricks in accordance with input signals from light probes 25. A trick-winning output signal from any of light probes 25 advances trick counter 54 by one count. Card-playing outputs from light probes 25 activate trick memory 55 for loading therein of trick counts or codes from trick counter 54. Card-playing output signals from light probes 25 can occur only in synchronism with the generation of card designation signals by refresh driver 53. Thus trick memory 55 can be actuated by light probes 25 to load trick codes only in a sequence position in memory corresponding to the light emitting diode (or card) being viewed by the light probe. Trick-winning signals from light probes 25 are also gated into a trick circuit 52, which controls trick display 24.

Arithmetic logic unit 57 generates a hand strobe on line 118 whenever it receives a zero trick code from trick memory 55. Reception of such a zero trick code indicates that no trick code has been loaded into trick memory 55 for the card whose designation is at that instant being generated by refresh driver 53. Arithmetic logic unit 57 also generates a hand strobe on line 118 when the trick code read out from trick memory 55 is greater than the trick code received from trick counter 54. This accommodates replay of the previous hand, for which the trick memory is not cleared.

Figure 5:
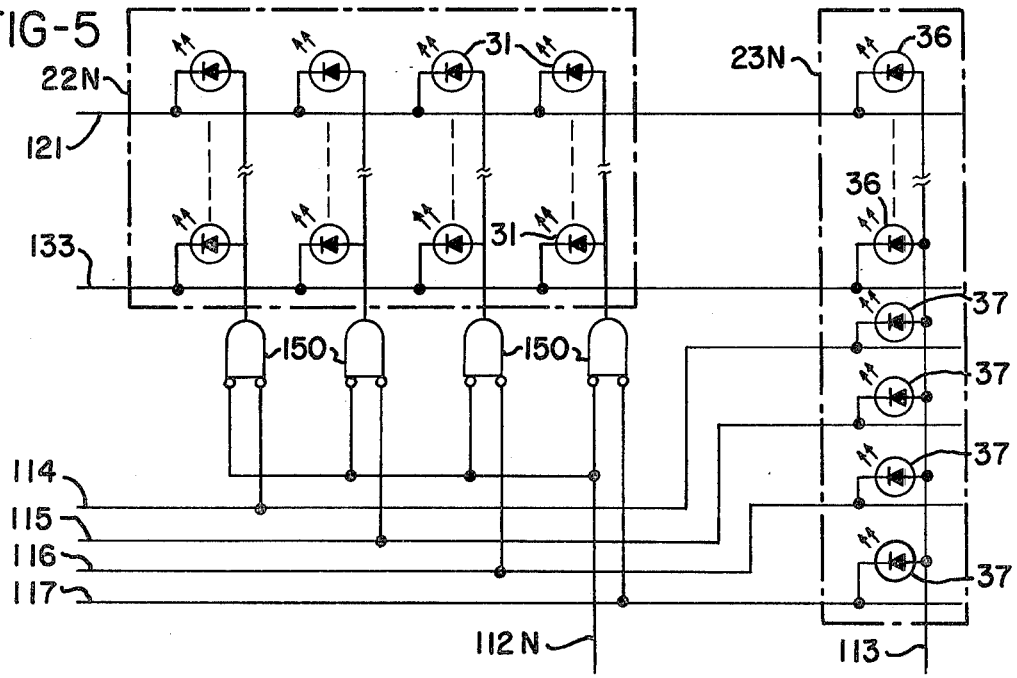
FIGS. 5 through 10 are simplified electrical schematic diagrams for implementation of the system illustrated in FIG. 4.

The operation of hand displays 22 and play displays 23 may be understood by referring to FIG. 5, which illustrates the circuitry for one hand, such as the North hand. As illustrated therein the hand display 22N comprises four sets of light emitting diodes 31, each of which is connected to receive an output from an AND gate drivers 150. AND gate drivers 150 have inverters at their input sides, and all receive a steering input from line 112N. Each AND gate driver 150 also receives an input from one of lines 114 through 117, which are normally high and are strobed LO to indicate club, diamond, heart, and spade suit indications respectively.

There are thirteen light emitting diodes 31 connected to the output side of each AND gate driver 150, and the thirteen light emitting diodes in each such set are respectively connected to one of lines 121 through 133. Lines 121 through 133 are normally HI and are strobed LO for designation of card ranks ace through duece. As illustrated in FIG. 5, LO strobes appearing simultaneously on lines 117 and 121 would designate the ace of spades in all four hand displays 22. A LO strobe appearing simultaneously therewith on line 112N would steer the ace of spades designation to the North hand and illuminate the upper right hand light emitting diode 31 in hand display 22N.

As further illustrated in FIG. 5, the North play display, 23N, includes thirteen light emitting diodes 36 connected to lines 121 through 133 and four light emitting diodes 37 connected to lines 114 through 117. All of light emitting diodes 36 and 37 as illustrated are also connected to line 113N, which carries a steering signal for the North hand play display. As illustrated LO signals appearing simultaneously on lines 121 and 117, together with a HI signal on line 113N, will illuminate the top light emitting diode 36 and the bottom light emitting diode 37 to designate the ace of spades in the North play display.

Figure 7:
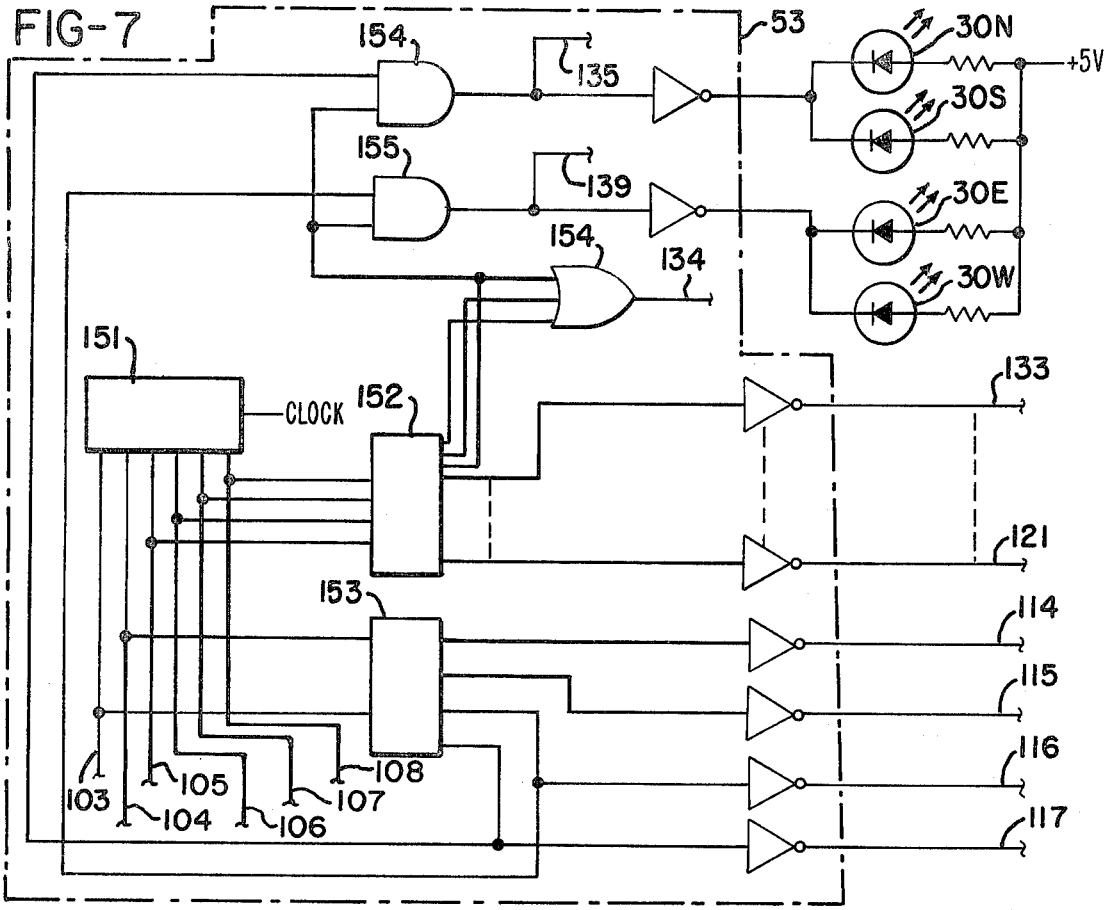

Card designation signals for lines 114 through 117 and 121 through 133 are generated by refresh driver 53 as illustrated in detail in FIG. 7. The heart of refresh driver 53 is a six-bit counter 151, which counts clock pulses to generate six-bit binary codes representing the numbers 0 through 63. Counter 151 continually cycles through its six-bit count. The clock pulses for counter 151 occur at a frequency of about 2,560 hertz, so that counter 151 begins a new count at a frequency of about 40 hertz.

The six-bit output codes from counter 151 are directed to a four-bit decoder 152 and a two-bit decoder 153. Decoder 153 has four output lines for driving the suit designating lines 114 through 117, and decoder 152 has thirteen output lines for driving the card rank indicating lines 121 through 133. Decoder 152 also has three output lines connected to OR gate 154 for generating masking signals on line 134.

The cyclic six-bit output counts from counter 151 may be thought of as indicating sixty-four time periods T0 through T63. Accordingly a masking signal appears on line 134 during all of time periods T52 through T63. During time period T52 there will also be an output from NAND gate 154, and during time period T53 there will be an output from NAND gate 155, both of which outputs are due to connection as illustrated in FIG. 7. The outputs from NAND gate 154 cause illumination of the North and South trick indicating light emitting diodes 30N and 30S during time period T52. A signal is also supplied to line 135 during this time period. Similarly NAND gate 155 supplies a signal to line 139 and causes illumination of the East and West trick indicating light emitting diodes 30E and 30W during time period T53.

Figure 6:
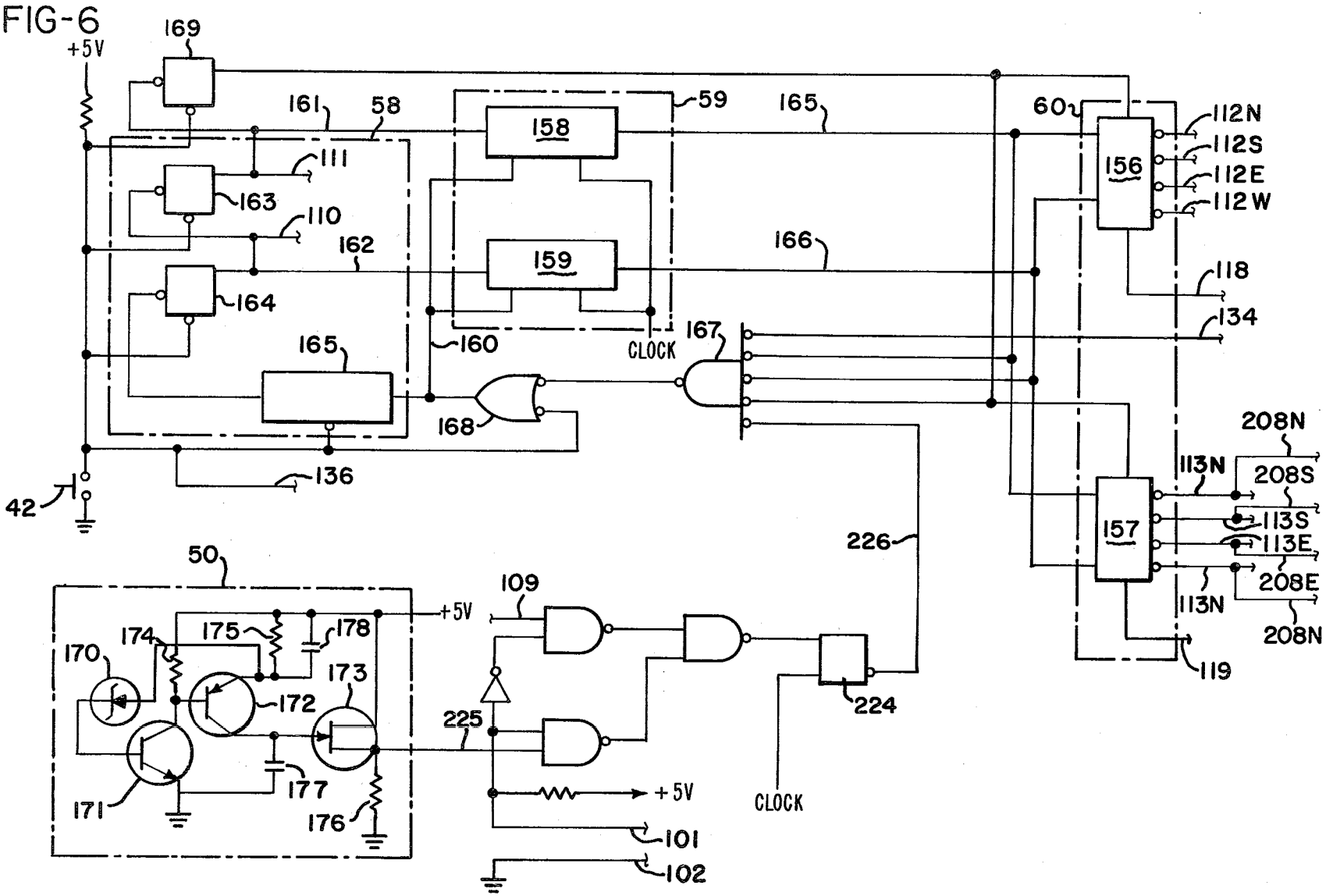

The operation of decoder 60 and hand memory 59 can be understood by reference to FIG. 6. As illustrated in that figure decoder 60 comprises two two-bit decoders 156 and 157, which are connected in parallel for decoding two-bit outputs from hand memories 59. Decoder 156 has four output lines 112N, 112S, 112E, and 112W for steering card designation signals from refresh driver 53 to hand displays 22 respectively for the North, South, East and West hands. Similarly decoder 157 has four outputs 113N, 113S, 113E, and 113W, for steering card designations signals respectively to the North, South, East, West play displays 23. Decoder 156 is activated by a hand strobe on line 118, and decoder 157 is activated by a play strobe on 119.

Hand memory 59 is a recirculating memory device comprising two recirculating shift registers 158 and 159. Each shift register 158 and 159 has 64 storage locations and bits in these 64 locations are continually recirculated through all locations. Recirculation of these shift registers is under control of a clock signal which is locked in phase and frequency with the clock signal for six-bit counter 151 in refresh driver 53. Shift registers 158 and 159 are loaded with inputs from lines 161 and 162 respectively whenever a HIGH signal appears on line 160. The signals on line 161 and 162 collectively represent a two-bit hand code.

The signals on lines 161 and 162 represent outputs from flip-flops 163 and 164 respectively. Flip-flops 163 and 164 are connected to produce a binary count from 0 through 3 in response to output pulses from a counter 165. Counter 165 is a thirteen-bit counter, so that thirteen input counts to counter 165 produce one output count for flip-flops 163 and 164. Each input count for counter 165 appears on line 160 for loading shift registers 158 and 159. Consequently each binary number from 0 through 3 is loaded thirteen times into hand memory 59. The output count from hand memory 59 appears on lines 165 and 166, and these lines are connected to inverters feeding the input of a NAND gate 167.

The output from NAND gate 167 is applied to an OR gate 168 as illustrated to prevent generation of a load signal on line 160 whenever a high output occurs on either of lines 165 or 166. This prevents loading of any of binary codes 1 through 3 into any position in the hand memory shifting sequence already occupied by a hand code. Furthermore the masking signal, which is generated as above described for application to line 134, prevents loading of hand codes into any of positions 52 through 63 of the shifting sequence (corresponding to time periods T52 through T63). Thus positions 0 through 51 of the shifting sequense are loaded with 52 hand codes including thirteen of each of the binary codes for 0 through 3. The positions of the hand codes within the shifting sequence depend upon the time of appearance of load signals on line 160 relative to the cyclic clocking operation of hand memory 59.

After 52 hand codes have been loaded into hand memory 59, an output from flip-flop 169 is applied to NAND gate 167 to prevent generation of any additional load pulses on line 160. The output from flip-flop 169 also enables operation of decoders 156 and 157.

For normal operation without programming unit 21, load pulses for line 160 are generated by random time-out unit 50. Random time-out unit 50 comprises a zener diode 170 and circuitry as illustrated for amplifying noise generated by zener diode 170. Random time-out unit 50 thus generates a series of spikes on line 225, which produce LO output pulses at random time intervals on normally HI line 226. While these LO pulses on line 226 occur randomly in time, their occurence is nevertheless sufficiently frequent to enable loading of 52 hand codes into hand memory 59 in a few seconds. Each LO pulse on line 226 causes creation of a load pulse on line 160, provided that during appearance of such LO pulse on line 226 the signals on all other input lines for NAND gate 167 are also LO. Such an arrangement causes each of four different hand codes to be loaded thirteen times in a random sequence within the 52 positions in the shifting sequence of hand memory 59.

Zener diode 170 may be a 3.3 volt device. Transistor 171 amplifys noise obtained about the knee of the zener, and in addition provides the base drive for transistor 172. Transistor 172 serves as a current source for capacitor 177 in response to the high frequency noise components produced at the collector of transistor 171.

Current spikes are integrated by capacitor 177 until UJT 173 fires discharging capacitor 177. The resulting positive pulse obtained on line 170 is sufficient to propagate a logic HI to flip-flop 224 for a 10 microsecond period. Should a clock edge transistor occur during this 10 microsecond period then flip-flop 224 will become set providing the random time out pulse on line 226.

Figure 8:
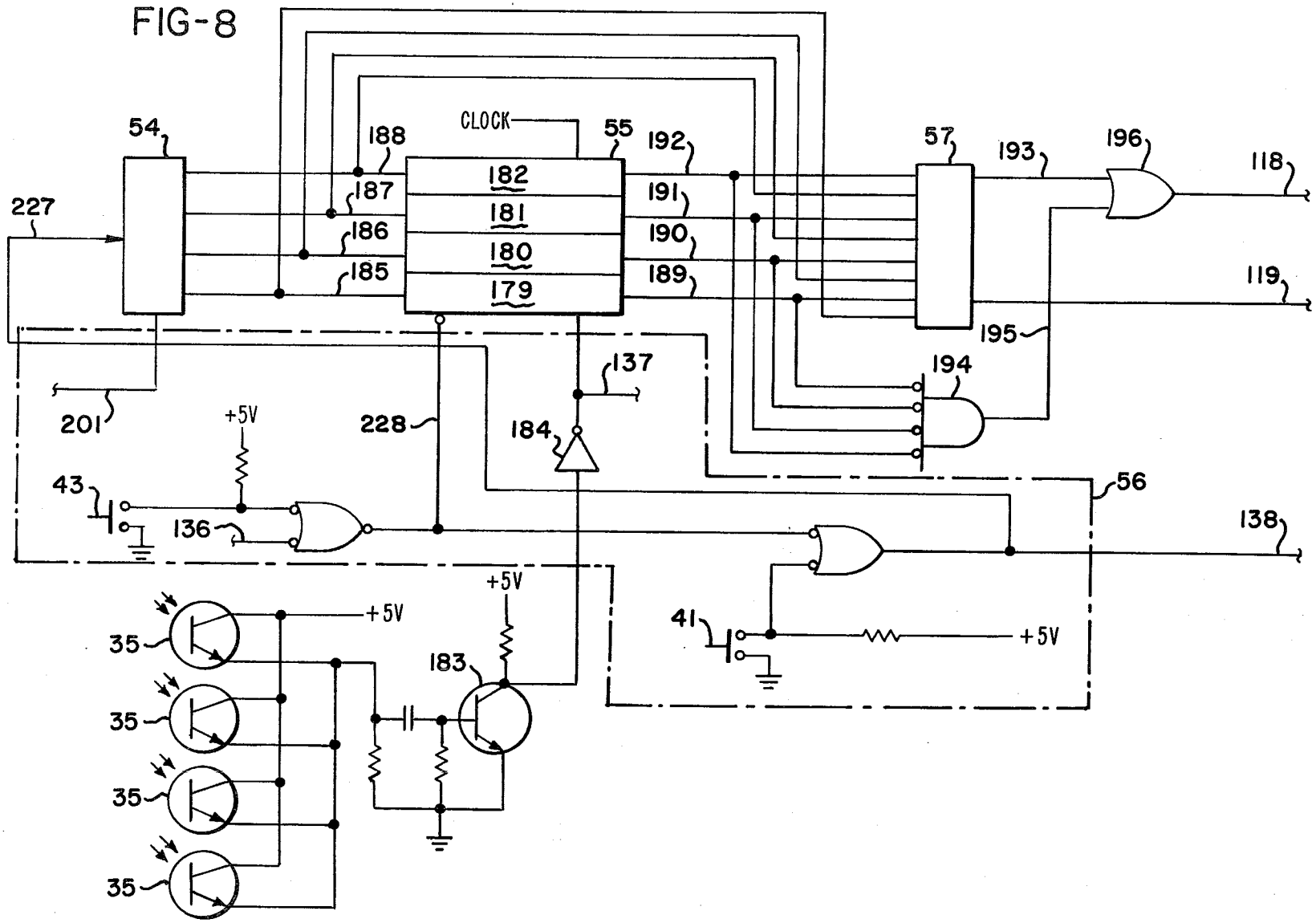

Referring now to FIG. 8 the operation of trick memory 55 and sensors 35 may be understood. Trick memory 55 comprises four recirculating shift registers 179 through 182, which are clocked in synchronism with shift registers 158 and 159 of hand memory 59. As described above shift registers 158 and 159 operate in phase with refresh driver 53. This causes each hand code to circulate through hand memory 59 in synchronism with the generation of card designation signals specific to a particular card. Whenever one of detecting probes 25 is placed against an illuminated light emitting detector 31 in a hand display 22, the photosensor 35 of the detecting probe senses light pulses in synchronism with the generation of card designation signals designating the illuminated LED being detected.

The detected light pulses cause the detecting photosensor 35 to act through transistor 183 and inverting amplifier 184 for generation of a trick memory load pulse. The load pulse so generated causes a four-bit binary trick code appearing on lines 185 through 188 to be loaded into recirculating shift registers 179 through 182. It will be appreciated that since the load pulse is generated during illumination of a LED representing a specific card, the trick code loaded into trick memory 59 at that same instant will represent a trick code for that card. The count on lines 185 through 188 is generated by counter 54 which counts trick-won pulses appearing on line 201. This insures that the trick code loaded into trick memory 55 for any card represents the trick during which that card was played.

Trick code memory 55 has output terminal means which read out trick codes onto lines 189 through 192. Trick codes are continually recirculating through trick memory 55, and at any point in time the code appearing on lines 189 through 192 is associated with the card being simulated at that exact time. If the card has not yet been played, then lines 189 through 192 carry a code consisting of all zeros. If the card has been played, however, then the code represents the number of the trick during which that card was played.

As further illustrated in FIG. 8, lines 185 through 188 and lines 189 through 192 are all connected to the input side of arithmetic logic unit 57. Arithmetic logic unit 57 compares the code on line 185 through 188 with the code on lines 189 through 192, thus comparing the current trick number with the trick numbers of all cards being simulated. Whenever the trick number of a card being simulated is greater than the current trick number, it means that the card has not yet been played during the current game. Such a condition never happens during the simulation of an ordinary game, but it does happen during the replay mode. For the occurrence of such a condition, therefore, arithmetic 57 generates an output signal on line 193.

Line 193 is connected to OR gate 196, which also receives an input from line 195. Line 195 in turn is the output line from AND gate 194. Line 195 is HI when all of lines 189 through 192 are LO, which represents the trick code for an unplayed card during a normal game simulation. Thus OR gate 196 generates an output signal whenever a card then being simulated has not yet been played, either during a normal game (as evidenced by a HI signal on line 195) or during the replay mode (as evidenced by a HI signal on line 193). Output signals from OR gate 196 are applied to line 118 for use as hand strobes. Operation of such hand strobes in the decoding of hand codes has been described above in connection with FIG. 6.

Without the occurrence of a hand strobe, no card may be simulated by any hand display 22.

In order to simulate a card on any of the play displays 23 it is necessary to generate a play strobe on line 119. Line 119 is strobed by arithmetic logic unit 57 whenever the output code from trick counter 54 is equal to the output code from trick memory 55. Such equality of codes means that the card then being simulated has been played during the current trick. Thus as described above the card will be simulated on the appropriate play display 23. No card may be simulated without generation of either a hand strobe on line 118 or a play strobe on line 119.

Control unit 56 for trick counter 54 is also illustrated in FIG. 8. As therein illustrated, trick counter 54 is connected to a line 227 for presetting to a trick count of 0001 by closing of either Replay switch 41 or Same Deal switch 43. A LO signal on line 136 will also preset trick counter 54 to a trick count of 0001, and this happens when Deal switch 42 (FIG. 6) is closed. Closing of either Deal switch 42 or Same Deal switch 43 also produces a clear signal on line 228 for shift registers 179 through 182. Shift registers 179 through 182 each have 64 storage positions (of which only 52 are significant) and all of these locations are loaded with zeros whenever Deal switch 42 or Same Deal switch 43 are closed. Shift registers 179 through 182 are not reset when Replay switch 41 is closed. Whenever any of switches 41 through 43 are closed a HI signal is generated on line 138, and this signal clears counters 197 and 198 in trick circuit 52 (FIG. 9).

An option not illustrated in FIG. 8 includes a gating network for connecting line 193 to line 228. This option permits selective clearing of only these storage positions within registers 179 through 182 which carry trick numbers higher than the number stored in register 54. Thus it is possible to replay a portion of a game and reset the trick memory for new playing of the remainder of the game.

Figure 9:
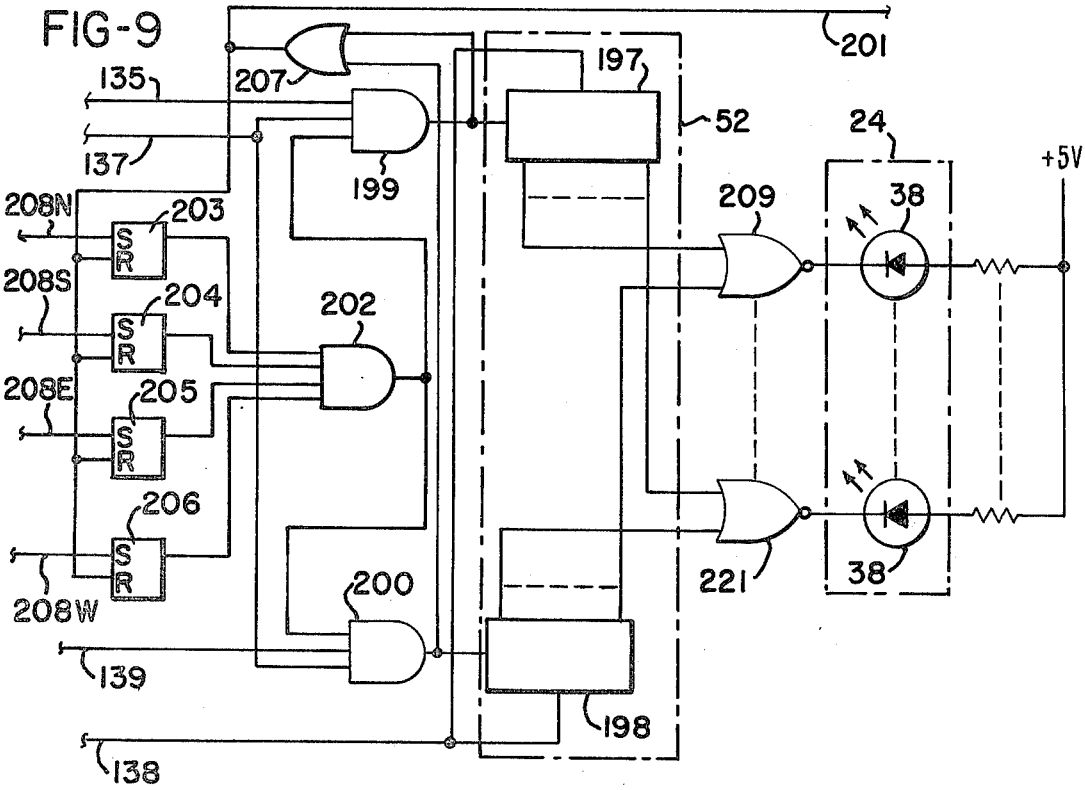

Referring now to FIG. 9, counter 197 is the North-South trick counter, and counter 198 is the East-West trick counter. Trick counters 197 and 198 are loaded with output pulses from AND gates 199 and 200 respectively. AND gates 199 and 200 each have three inputs. Both of these AND gates have an input from line 137 and another input from the output of AND gate 202. The third input for AND gate 199 is received via line 135, and this line is HI during time period T52, which is the illumination time for the North and South trick indicating LEDs 30N and 30S (FIG. 7). Similarly AND gate 200 receives an input during time period T53 from line 139, which input corresponds to illumination of the East and West trick indicating LEDs 30E and 30W.

Line 137, which is common to both of AND gates 199 and 200, is activated by an output from any of photosensors 35 as illustrated in FIG. 8. Such an output appears on line 137 during time period T52 whenever one of photosensors 35 is detecting one of trick indicating LEDs 30N or 30S. Thus if one of detecting probes 25 is directed against one of the North or South trick indicating LEDs, this will provide two simultaneous HI inputs for AND gates 199, these inputs occurring during time period T52. Similarly lines 137 and 139 provide two simultaneous HI inputs for AND gate 200 if one of detecting probes 25 is directed against one of the East or West trick indicating LEDs. These simultaneous high inputs for AND gate 200 occur during time period T53.

Whenever AND gate 202 produces a HI output, AND gates 199 and 200 are enabled for producing output signals in response to detection of the trick indicating LEDs as above described. Output pulses from AND gate 199 are totaled for the North-South team by counter 197, and output pulses from AND gate 200 are totaled for the East-West team by counter 198. The output signals from AND gates 199 and 200 are also applied to OR gate 207, which is connected to reset four flip-flops 203 through 206. Flip-flops 203 through 206 in turn provide input signals for AND gate 202. Thus when a detecting probe 25 is placed against one of the trick indicating LEDs 30 at the end of a trick, one of AND gates 199 or 200 is enabled, and this in turn disables AND gates 199 and 200 until the end of the next trick. Accordingly one pulse is applied to one of counters 197 or 198 to advance the trick count for the appropriate side.

Flip-flops 203 through 206 are set by signals received respectively from lines 208N, 208S, 208E, and 208W. These are output lines from decoder 157 as illustrated in FIG. 6. At the beginning of any trick each of these lines is initially LO. Then as each player in turn plays a card, a corresponding one of lines 208 begins receiving periodic pulses from decoder 157. This in turn sets one of flip-flops 203 through 206. After all four players have played a card, all of flip-flops 203 through 206 are set, and AND gates 199 and 200 are enabled for transmitting a trick count to one of counters 197 or 198. Transmission of a trick count to either of these counters also causes appearance of a "trick-won" pulse on line 201, which is connected to the output side of OR gate 207. As illustrated in FIG. 8, a pulse on line 201 advances the count in trick counter 54.

Counters 197 and 198 each have thirteen output lines, which are activated on a sequential basis in accordance with the trick count in their corresponding counters. The output lines from counters 197 and 198 are connected to a series of thirteen NOR gates 209 through 221, only two of these NOR gates being illustrated. Each of NOR gates 209 through 221 has an input from both of counters 197 and 198, with the connections being in inverse order. Thus NOR gate 209 produces a low output for a "one" count in counter 197 or a "thirteen" count in counter 198. Similarly NOR gate 221 produces a low output for a "thirteen" count in counter 197 or a "one" in counter 198. The non-illustrated NOR gates between NOR gates 209 and 221 are connected in like manner for causing activation of the appropriate ones of light emitting diodes 38.

Figure 10:
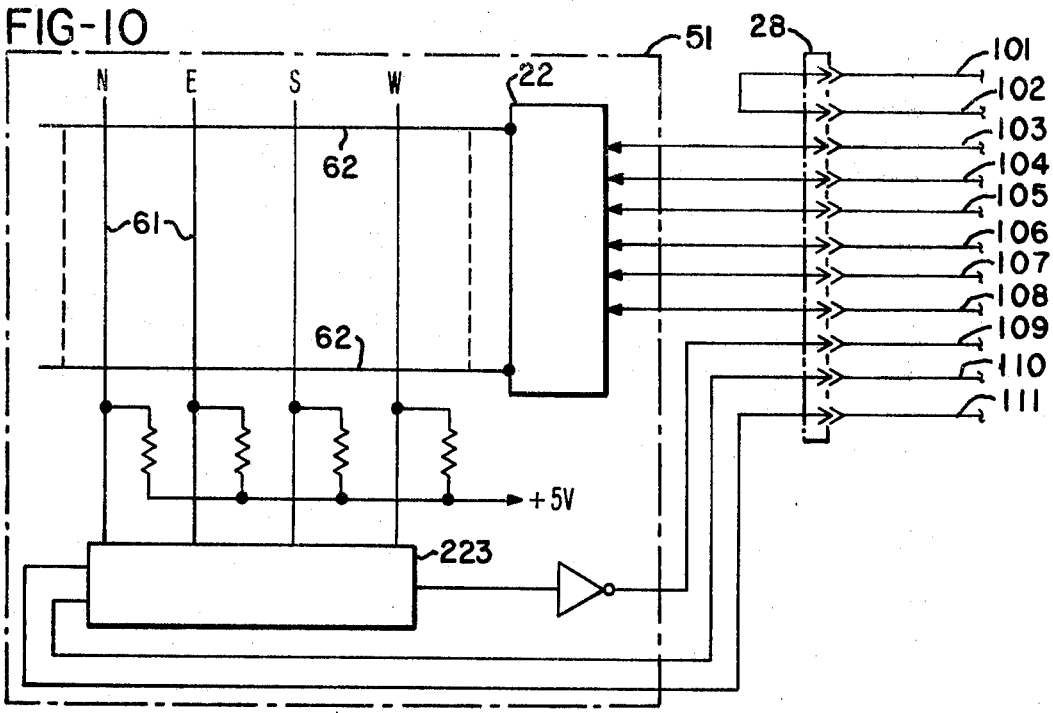

FIG. 10 illustrates the electrical connections for card controlled time-out unit 51. This unit becomes activated by inserting plug 28 into place in the side of disply unit 20. As shown in FIG. 10, plug 28 completes a connection between lines 101 and 102, thereby grounding line 101 and preventing random time-out unit 50 from generating load signals for hand memory 59. At the same time line 109 is connected to supply load signals for hand memory 59 from the card controlled time-out unit 51.

Load pulses on line 109 are generated in synchronism with the generation of card designation signals on a predetermined basis. This is accomplished through use of a 1 of 52 decoder 222, which is conected to decode six-bit code words appearing on lines 103 through 108. Lines 103 through 108 are output lines from six-bit counter 151 as shown on FIG. 7. As previously described the output count from counter 151 designates the 52 cards for simulation and establishes 64 time intervals of which 52 are utilized for assignment of hand codes and trick codes.

Decoder 222 has 52 output lines 62, which are selectively activated in response to the codes appearing on input lines 103 through 108. Each of lines 62 is connected to one of four lines 61 by means of an electrically conductive elastomeric pad 63 as described below. Line 61 corresponds to the four playing hands and are connected to the input side of a multiplexer 223. Connector 28 connects the selector terminals of multiplexer 223 to line 110 and 111 for selection of one of the lines 61.

As shown in FIG. 6 lines 110 and 111 are connected to the output terminal of flip-flops 163 and 164, so that lines 110 and 111 carry the same two-bit hand code which is applied to the input terminals of hand memory 59.Thus as the code on lines 103 through 108 cycles through 52 card designation codes, multiplexer 223 reads one of lines 61 to determine which cards are held by the corresponding hand. Pulses corresponding to these cards are transmitted via line 109 and other components illustrated in FIG. 6. to line 160 for loading control of hand memory 59. Thus hand memory 59 is loaded with hand assignments for each card in accordance with preprogrammed connections between lines 62 and lines 61 in the card control time-out unit 51.

Figure 11:
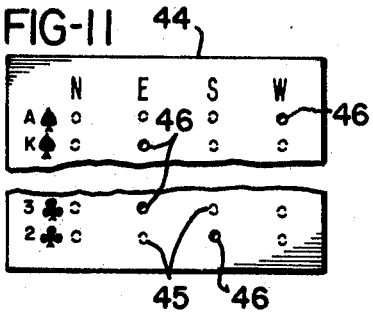
FIG. 11 is an illustration of a programming card for causing a card game simulator to simulate a predetermined deal.

FIG. 11 illustrates a programming card 44 which may be utilized in programming unit 21 for making the above mentioned preprogrammed connections between lines 62 and lines 61. Card 44 may be made of a plastic material and may be provided with a series of 52 perforated holes 45 under the heading N, E, S, and W, which indicate the four hands to which card assignments may be made. Each of perforated holes 45 indicates one of the fifty-two cards in a standard bridge deck. Card assignments to the various hands are made by selectively punching out one of the four perforated holes corresponding to each of the 52 card designations. Such punched out holes, as indicated by the reference numerals 46, may indicate, for instance, that the ace of spades is assigned to the West hand, and that the two of clubs is assigned to the South hand.

Figure 12:
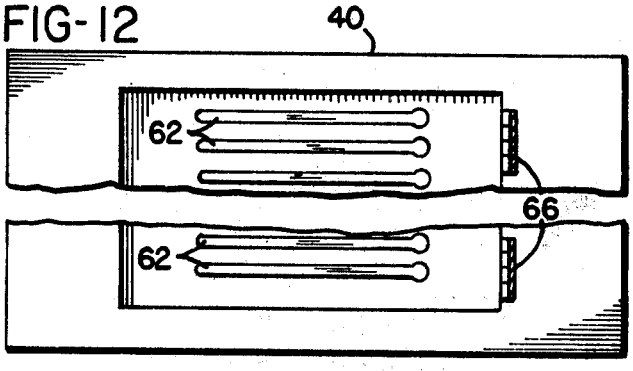
FIG. 12 illustrates the front of a programming unit with the door removed.

FIG. 12 illustrates the lines 62, as they appear in a programming unit 21 with door 39 removed. Lines 62 are printed circuit lines within main frame 40 and are connected to decoder 222 by means of connections not illustrated.

Figure 13:
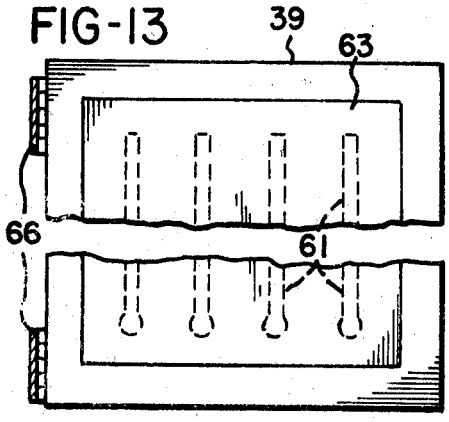
FIG. 13 illustrates the inside of a door for a programming unit.

Lines 61 may be printed circuit elements within door 39 as illustrated in FIG. 13. Lines 61 are connected to multiplexer 223 by connections not illustrated in FIG. 13 and are covered by elastomeric pad 63. Door 39 is hinged to main frame 40 by means of hinges 66.

Figure 14:
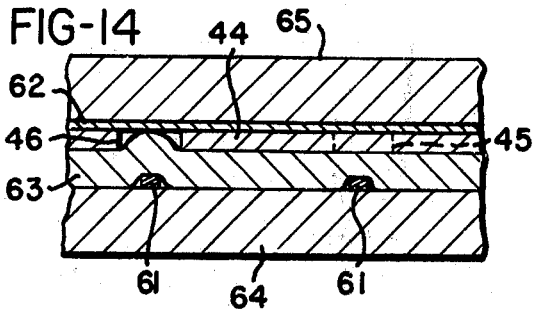
FIG. 14 is a cross sectional illustration of a portion of a programming unit with the door closed and a programming card in place.

As illustrated in FIG. 14, lines 61 cause localized bulging of elastomeric pads 63 through punched out holes 46 for contact with preselected ones of lines 62. Lines 62 are printed upon a plastic board 65, while lines 61 are printed upon a plastic board 64.

It will therefore be understood that simulated dealing of a preselected set of bridge hands may be accomplished by punching out the appropriate holes in a programming card 44, inserting the card in programming unit 21 and thereafter locking door 39 in place. The pressure associated with locking of the door causes elastomeric pad 63 to bulge as above described and to cause electrical connection between the appropriate ones of lines 62 and 61. In this regard it will be noted that elastomeric pad 63 is a relatively good electrical connector in the direction across its thickness, but it had a relatively high resistance in other directions. Such materials are well known, and a suitable material is sold commercially Tecknit of Cranford, New Jersey under the trademark SC-CONSIL.

While the forms of apparatus herein described constitute preferred embodiments of the invention, it is to be understood that the invention is not limited to these precise forms of apparatus, and that changes may be made therein without departing from the scope of the invention.

What is claimed is:

1. A card game simulator comprising a plurality of hand displays each of which has a plurality of light generating elements for representation of playing cards capable of being held by that hand, card assignment means for assigning playing cards to each such hand, a recirculating hand memory for storage of said card assignments, illumination control means responsive to said hand memory for periodically activating in each hand display the light generators representing cards assigned to that hand, a photosensitive detector for detecting illumination of any of said light generators when placed in close proximity thereto, a recirculating trick memory synchronized with said hand memory and actuated by an output from said detector for remembering the time period of said output, and gating means connected to said trick memory for preventing said illumination control means from activating a light generator during occurrence of time periods remembered by said trick memory; said trick memory comprising a trick code generator, means for loading codes from said trick code generator into the trick memory in response to output signals from said detector, output terminal means for reading out trick codes previously loaded into said trick code memory, and means connected to said output terminal means for generating control strobes for said gating means in response to trick codes read out from said output terminal means.

2. A card game simulator according to claim 1 wherein said card assignment means comprises means for loading said hand memory with hand codes uniquely representing different ones of the hand displays comprising said simulator and means for causing each unique hand code to be loaded into said hand memory the same number of times; said illumination control means being connected for sequential reading of the hand codes stored in said memory.

3. A card game simulator comprising a first recirculating memory for receiving, recirculating and reading out hand codes corresponding to hand assignments for a predetermined sequence of cards, a second recirculating memory operated in synchronism with said first recirculating memory for receiving, recirculating and reading out trick codes assigned during the course of play to the cards in said predetermined sequence, a plurality of hand displays responsive to card designation signals for simulating cards held by participating players, card designation means for generating said card designation signals in said predetermined sequence and in synchronism with the operation of said memories, steering means for steering said card designation signals to selected ones of said hand displays under control of the hand codes read out from said first memory, means for generating said hand codes and causing said hand codes to be loaded into said first memory, manually operated playing means for indicating the playing of cards simulated by said hand displays, a trick code generator responsive to said playing means for generating said trick codes and causing said trick codes to be loaded into said second memory in sequential positions for association with the cards being played, and gating means responsive to trick codes read out from said second memory for gating the simulation by said hand displays of cards corresponding to said trick codes.

4. A card game simulator according to claim 3 wherein said hand displays comprise light emitting devices connected for control by said card designation signals, whereby cards assigned to said hand displays are simulated.

5. A card game simulator according to claim 4 wherein said playing means comprises a photosensing device for sensing illumination of one of said light emitting devices when placed in proximity therewith.

6. A card game simulator comprising a recirculating hand memory for sequentially and repetitively reading out a series of hand codes corresponding to hand assignments for each of a plurality of cards to be used in a card game being simulated by said simulator, a plurality of hand displays each including a separate light generating element for representation of each of said cards, decoding means for decoding said series of hand codes and generating hand enabling signals for the hand displays represented thereby, means for generating card designation signals is synchronism with the generation of said hand codes, means responsive to said hand enabling signals and said card designation signals for causing said light generating elements to indicate on a sequential basis all cards being simulated, each such indication being made in the hand to which the simulated card has been assigned, manually operable sensing means for sensing a selected card indication, and inhibiting means for inhibiting card indications after they have been sensed by said sensing means, said inhibiting means comprising a recirculating trick memory operated in synchronism with said hand memory and provided with output terminal means for reading out trick codes associated with the same cards for which said hand memory reads out hand codes, trick code generating means, means responsive to said sensing means for causing a trick code to be loaded from said trick code generating means into said trick memroy whenever said sensing means senses a card indication, logic means connected to said trick memory output terminal means for generating a hand strobe when the signal appearing at said terminal means indicates that the associated playing card has not yet been played, and means preventing card indications in said hand displays in the absence of a hand strobe.

7. A card game simulator according to claim 6 wherein said trick code generating means comprises a counter for counting the output indications from said sensing means and producing trick codes corresponding to the number of the trick during which simulated cards are played.

8. A card game simulator according to claim 7 further comprising means to load an initializing trick code into all positions in said trick memory, said logic means being connected to said trick code generating means as well as to the output terminal means of said trick memory and configured for generating a hand strobe whenever the output code from said trick memory is equal to said initializing trick code or whenever the output code from said trick memory represents a higher trick number than the code generated by said trick code generating means.

9. A card game simulator according to claim 8 wherein said logic means produces play display strobes when identical trick codes are generated by said trick code generating means and the output terminal means of said trick memory and wherein said card game simulator further comprises play displays corresponding to said hand displays and positioned for viewing by all players, said play displays comprising means for indicating cards being played from the corresponding hands during the tricks being simulated and being connected for production of said card indications under control of said play display strobes, said hand codes and said card designation signals.

10. A card game simulator according to claim 9 further comprising card assignment means for generating each of the aforementioned hand codes an equal number of times and causing said hand codes to be stored in said hand memory.

11. A card game simulator according to claim 10 wherein said card assignment means comprises means for causing said hand codes to be stored in said hand memory in a random sequence.

12. A card game simulator according to claim 11 further comprising a manually operated same deal control, a manually operated new deal control, means responsive to operation of either of said deal controls for clearing said trick memory and resetting said trick code generator to generate said initializing trick code, and means responsive to operation of said new deal control for causing said card assignment means to load a new sequence of hand codes into said hand memory.

13. A card game simulator according to claim 12 further comprising a manually operated replay control means responsive to operation of said replay control for resetting said trick code generator to a game initiation condition, and manually operated means for advancing the count in said trick code generator to simulate a replay of the previous game.

14. A card game simulator according to claim 10 wherein said card assignment means comprises a programming unit for causing said hand codes to be stored in said hand memory in a predetermined sequence.

15. A card game simulator according to claim 6 wherein said light generating elements are light emitting diodes which are lighted to produce aforesaid card indications.

16. A card game simulator according to claim 15 wherein said hand codes are generated at a sufficiently high frequency to cause said card indications to appear continuous to the human eye.

17. A card game simulator according to claim 16 wherein there are four hand displays, four play displays, 52 light emitting diodes in each hand display, and means associated with said light emitting diodes for representing the 52 cards in a standard deck; said hand memory and said trick memory each being structured to read out 52 codes on a cyclic basis for simulating a game of bridge.

18. A card game simulator according to claim 17 further comprising manually actuated means for indicating which pair of the four simulated hands wins any given trick and means responsive to said indication for totaling and indicating the tricks won by each side.

* * * * *